US009364711B1

(12) United States Patent
Keck et al.

(10) Patent No.: US 9,364,711 B1
(45) Date of Patent: Jun. 14, 2016

(54) MUSCLE ACTUATION APPARATUS AND METHOD

(71) Applicant: HCD Agency LLC, Los Angeles, CA (US)

(72) Inventors: Henry C. Keck, South Pasadena, CA (US); Bahram Valiferdowsi, Glendora, CA (US)

(73) Assignee: HCD AGENCY LLC, Los Angeles, CA (US)

( * ) Notice: Subject to any disclaimer, the term of this patent is extended or adjusted under 35 U.S.C. 154(b) by 0 days.

(21) Appl. No.: 14/121,186

(22) Filed: Aug. 11, 2014

(51) Int. Cl.
*A63B 21/02* (2006.01)
*A63B 23/20* (2006.01)

(52) U.S. Cl.
CPC ..... *A63B 23/20* (2013.01); *A63B 21/02* (2013.01)

(58) Field of Classification Search
CPC ..... A63B 21/00185; A63B 21/00058; A63B 21/00069; A63B 21/00072; A63B 21/00076; A63B 21/02; A63B 21/0407; A63B 21/0414; A63B 21/0421; A63B 21/05; A63B 21/055; A63B 21/1446; A63B 23/03; A63B 23/032; A63B 23/14; A63B 23/16; A63B 23/20
USPC ..... 482/10, 11, 44–46, 49, 121, 122, 126, 482/128; 601/23, 33, 38, 40
See application file for complete search history.

(56) References Cited

U.S. PATENT DOCUMENTS

| | | | | | |
|---|---|---|---|---|---|
| 3,036,389 | A * | 5/1962 | Wesch | A43B 5/18 | 36/7.8 |
| 4,332,380 | A * | 6/1982 | Cardin | A63B 21/00043 | 482/126 |
| 4,729,560 | A * | 3/1988 | Cho | A63B 5/20 | 482/50 |
| 5,267,929 | A * | 12/1993 | Chen | A63B 21/00043 | 482/122 |
| 5,380,259 | A * | 1/1995 | Robertson | A63B 21/023 | 482/123 |
| 5,752,896 | A * | 5/1998 | White | A63B 23/16 | 482/44 |
| 6,258,015 | B1 * | 7/2001 | Blackford | A63B 23/20 | 482/121 |
| 6,881,177 | B2 * | 4/2005 | An | A63B 21/0004 | 482/121 |
| 8,118,726 | B1 * | 2/2012 | Blackford | A61F 2/0009 | 128/845 |
| 8,133,158 | B2 * | 3/2012 | An | A63B 21/0004 | 482/44 |
| 2006/0166797 | A1 * | 7/2006 | Hamer | A63B 21/055 | 482/121 |
| 2007/0037665 | A1 * | 2/2007 | Robbins | A63B 21/0004 | 482/11 |

* cited by examiner

*Primary Examiner* — Loan H Thanh
*Assistant Examiner* — Gregory Winter
(74) *Attorney, Agent, or Firm* — Workman Nydegger

(57) ABSTRACT

A muscle exercising apparatus including an elongated housing having two interrelated longitudinally elongated parts movable relatively away from one another to push laterally against body muscle, and a spring and slider combination operatively connected with the housing and relatively movable to control spread positioning of two housing parts, as the slider is displaced lengthwise of the housing parts.

7 Claims, 3 Drawing Sheets

18
12
14
25
16
13
17
11
11a
12a
26
10

5
17
12
18
25
10
5

10
11
11a
11c
11d
11e
12
12a
12a'
12a''
12c
12e
17
17a
17b
17c
17d
18
18c
20
23
24
25
26
36
36a
40

MUSCLE ACTUATION APPARATUS AND METHOD

BACKGROUND OF THE INVENTION

This invention relates generally to exercise of pelvic muscles such as sphincter muscles, to aid in birthing, and more particularly to improved apparatus and its method of use to provide such muscle exercise.

There is need for simplicity of operation and use of devices as referred to. In particular there is need for improvements in lengthwise and widthwise repeatedly adjustable apparatus as described herein, to facilitate and control exercise of pelvic muscles.

SUMMARY OF THE INVENTION

It is a major object of the invention to provide improved apparatus as referred to, including a female body internal muscle displacing actuator, including a spring and a spring displacing element such as a slider which is easily operable.

Another object is to provide improved method and apparatus enabling the user to controllably exercise sphincter muscles, to assist in muscle development, as by increasing awareness of strength and strengthening of such muscles.

Yet another object is to provide a simple spring, slider and housing combination wherein housing parts are movable relative to sphincter muscle or muscles, in response to manually controlled slider displacement along the spring, to effect controlled movement of a housing part, or parts, relative to such muscles.

Yet another object is to provide an improved device having basically four parts: a top housing, a bottom housing, a slider and a specially shaped flat spring co-operating with the slider, as follows:

1. The spring holds two housing parts in closed position.
2. Upon insertion into the user's body, the slider, which presses against the spring, is moved toward the body until the two housings are moved toward one another and fully open against spring force, as may be indicated by a marker.
3. At this point, as the slider is moved further toward the body, the fully open position of the two housings doesn't change except in response to the muscle force to close the two housings. The closer the slider is to the user's body, the greater the muscle exerted force required to close the two housings.
4. As the slider is pressing against the spring, it changes the effective length of the spring as it moves closer to the body making it harder and harder to close the two housings.

These and other objects and advantages of the invention, as well as the details of an illustrative embodiment, will be more fully understood from the following specification and drawings, in which:

DRAWING DESCRIPTION

DETAILED DESCRIPTION

Figure 1:
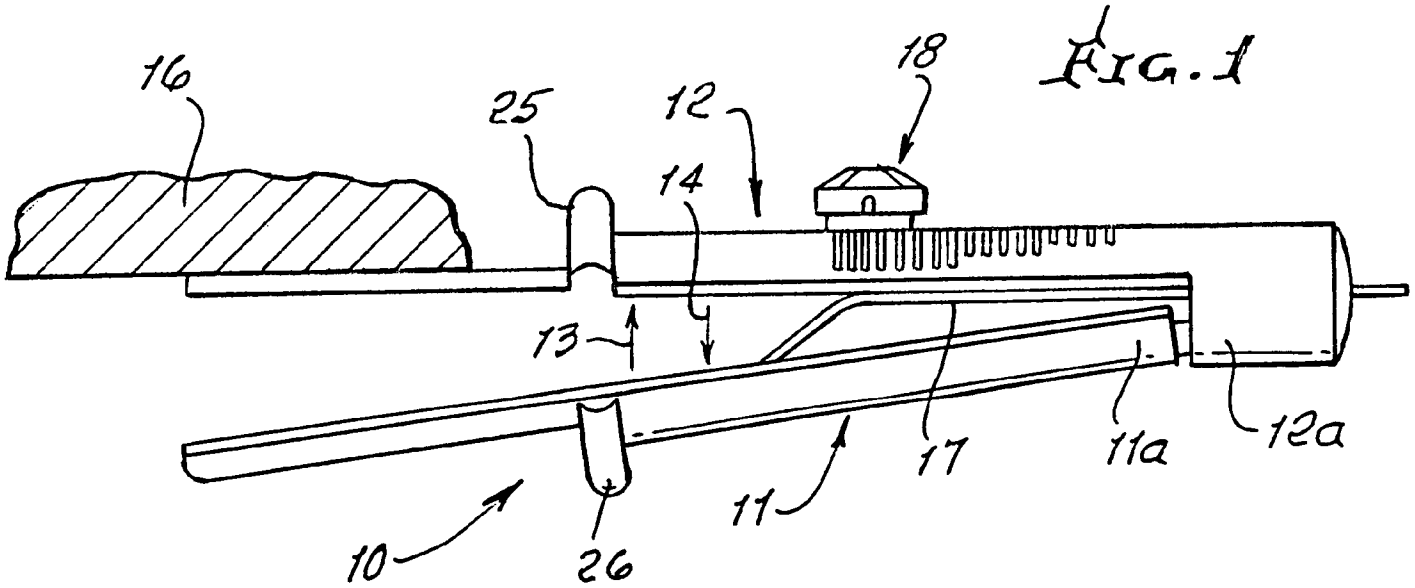
FIG. 1 is a side view of apparatus incorporating the invention.
Figure 2:
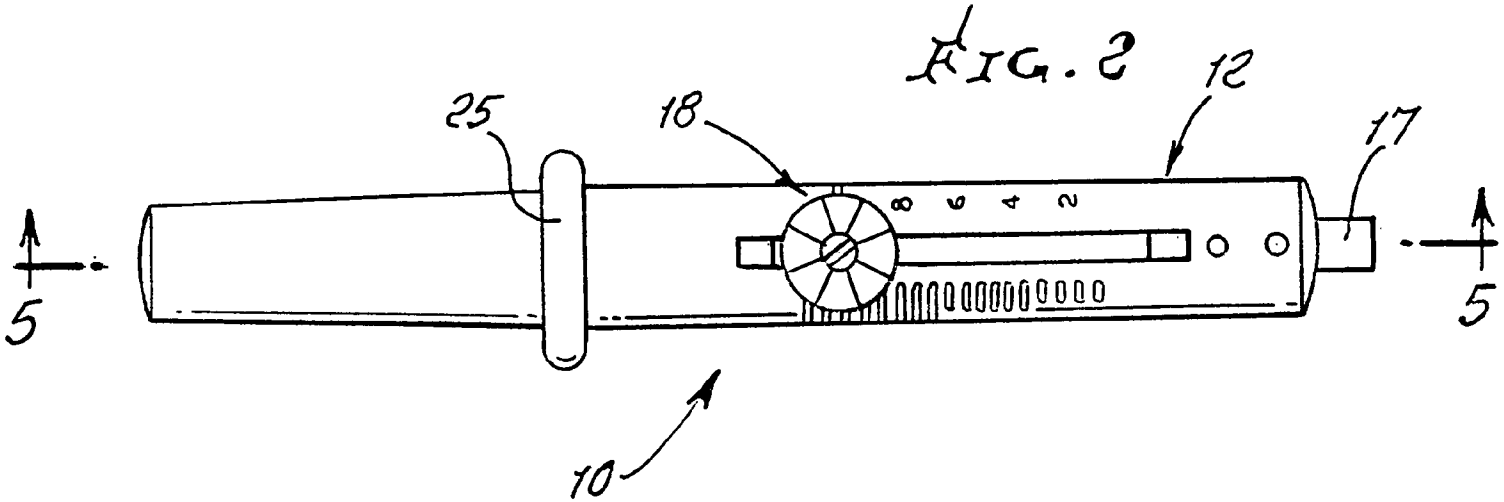
FIG. 2 is a frontal view of the FIG. 1 apparatus.

In the drawings, sphincter muscle exercise apparatus includes, basically, an elongated housing 10 having two elongated complementary parts 11 and 12, movable relatively toward one another (see arrow 13) and away from one another (see arrow 14) to push laterally against a user's body, i.e. sphincter muscle 16. Such movement is preferably pivoted movement, as enabled by hinge connection of ends 11*a* and 12*a* of parts 11 and 12. See hinge connection 10*a*.

A flat spring 17 and slider 18 combination is operatively connected with the housing, and relatively movable to control positioning of the two housing parts 11 and 12, as the slider is displaced directionally lengthwise of the housing parts and spring, and along longitudinal guide 20 on housing part 12. The spring has one end 17*a* thereof attached to the housing, as for example between end sections 12*a*' and 12*a*" of housing part 12.

The housing parts sections 12*a*' and 12*a*" are connected together to form a handle to be manually grasped outside the body, enabling moving of the slider 18 longitudinally lengthwise back and forth along the top of housing part 12*a*'. Flanges 24 and 25 on the housing parts limit insertion of housing parts forward ends 11*c* and 12*c* into the body.

The spring 17 extends along a plane at 17*b* along a slot 23 in housing part 11, and then curves at 17*c* into a slot 24 at the inner surface of part 11, to be slidably captivated by retainer 36 carried by 11. The retainer has a convex surface 36*a* facing the spring and its curved extent 17*c*, whereby the spring captivated free end portion is slidable relative to retainer 36 as the housing parts 11 and 12 adjustably spread apart and close toward and away from one another. The spring biasing extent 17*d* acts to resist housing parts 11 and 12 relative movement toward closed together position, as during insertion of the forward tapered extents 11*c* and 12*c* of the housing parts into the body. See FIGS. 3 and 4.

The slider has an inner tip 40 in sliding engagement with the surface of the flat spring in response to slider displacement lengthwise of the housing parts; and the spring end portion 17*c* slidably bears laterally against the inner surface of slot 23. The latter forms a elongated channel receiving and guiding the spring curved extent 17*c*. Flanges 25 and 26 on the housing parts limit insertion into the user's body.

It will be understood that the slider presses against the spring, and is movable in one direction along the spring until the two housing parts are fully opened away from one another, pressing against muscle, and further characterized in that the closer the slider is moved toward the human body, the greater the force required to displace said parts 11 and 12 relative to and toward one another.

Figures 3, 4, 5:
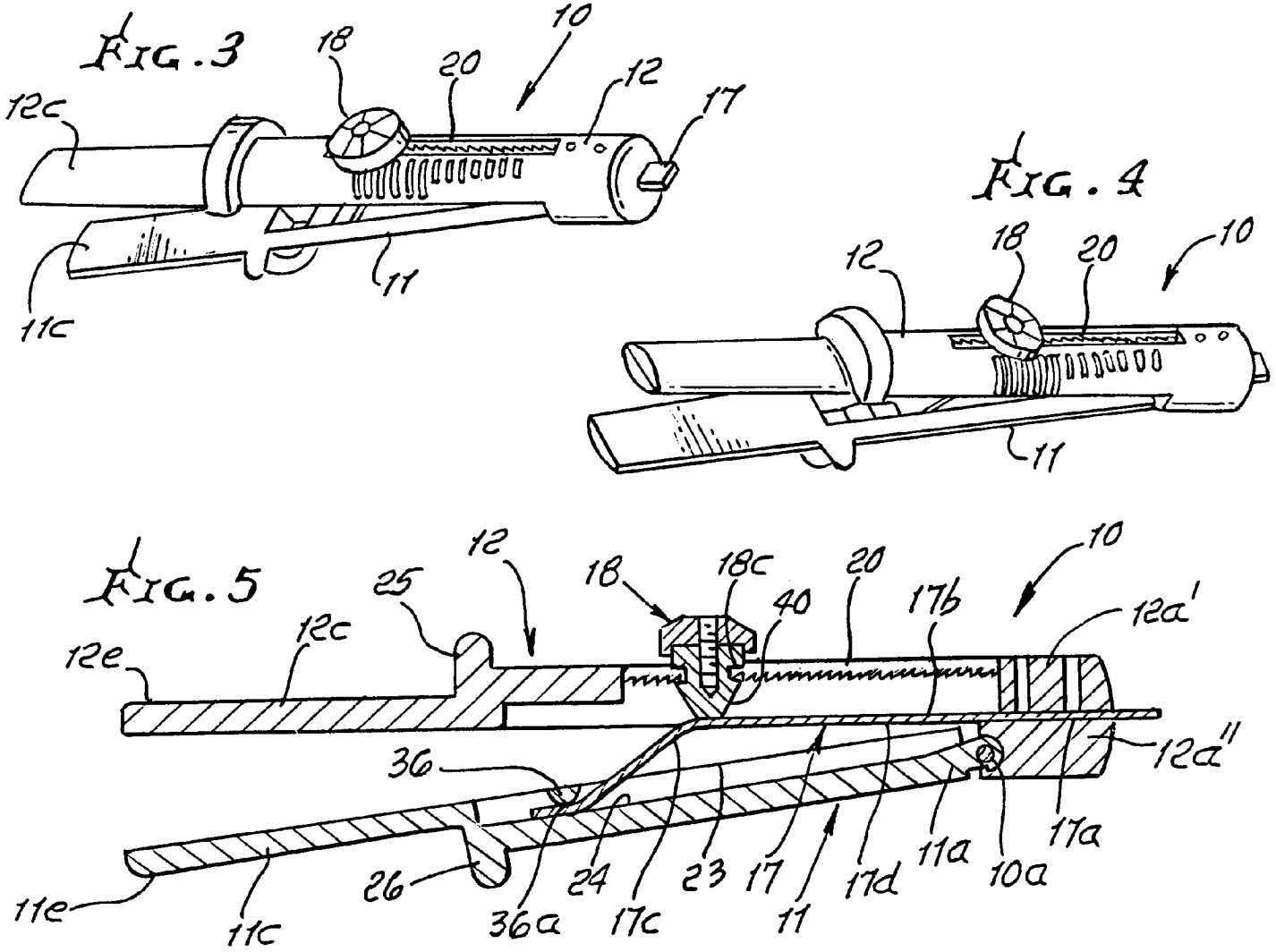
FIGS. 3 and 4 are perspective views of the apparatus.
FIG. 5 is a section taken on lines 5-5 of FIG. 2, through the device, to show position details of slider, spring, and two housing parts as the slider is displaced.

As the spring effective length is shortened, in response to movement of the slider to FIG. 5 position, the remaining effective length is biased to increasingly resist closure of the housing portions 11 and 12 toward one another. The slider locks at 18*c* into selected positions along the notched or serrated guide 20, to hold the spring in selected force exerting position forcibly interacting with muscles 16, until slider release from locked in position, by slider push-down.

Figure 6:
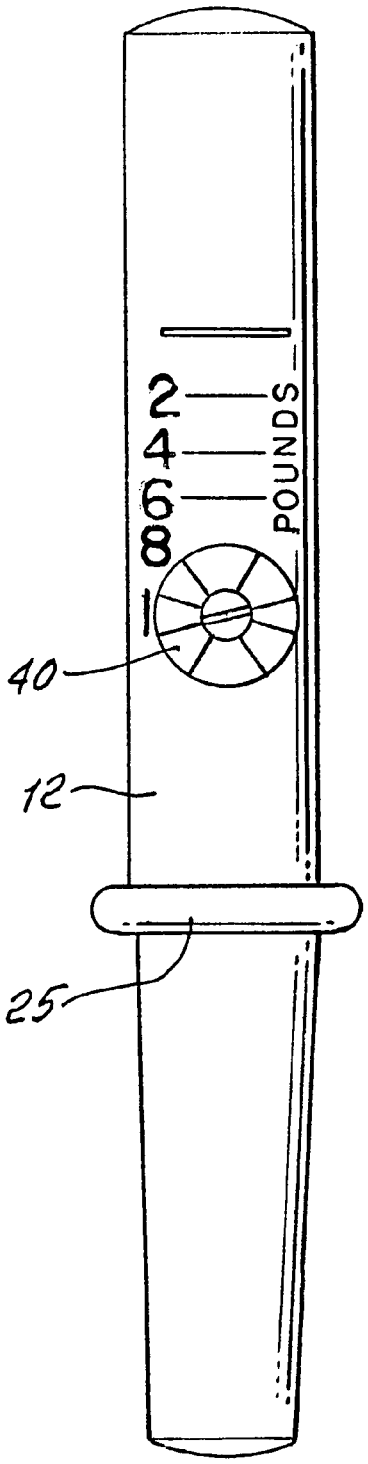
FIG. 6 is an enlarged top plan view of the device.
Figure 7:
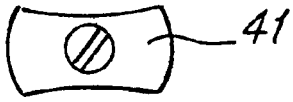
FIG. 7 is a plan view of a handle.
Figure 8:
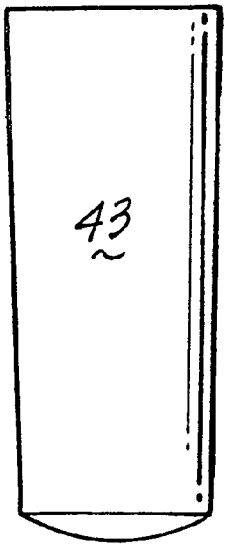
FIGS. 8 and 9 are views of a cover.
Figure 9:
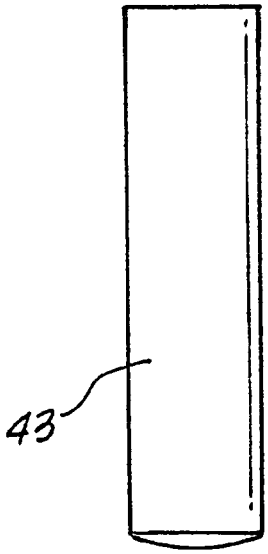

In FIGS. 1-5, the two elongated housing parts 11 and 12 have like insertion ends 11*c* and 12*c* that have like cross sections that remain substantially the same along such parts and to tips 11*e* and 12*e*. FIG. 6 shows slider top 40 and FIG. 7 shows a variation 41. Slider positions are indicated at 2, 4, 6 and 8. FIGS. 8 and 9 show a cover 43.

Operation of the device, in steps, is summarized as follows:

1. The spring holds the two housing parts normally closed.

2. Upon insertion in the user's body the slider, which presses against the spring, is pulled toward the body until the two housings are fully open as indicated by a marker.

3. At this point as the slider is pulled further toward the body the fully open position doesn't change except by the muscle force to close the two housings. The closer the slider is to the user's body the greater the force to close the two housings.

4. As the slider is pressing against the spring it changes the effective length of the spring as it gets closer to the body making it harder and harder to close the two housings.

What is claimed is:

1. A muscle exercising apparatus, comprising:

a) an elongated housing having two interrelated longitudinally elongated parts movable relatively away from one another to selectively push laterally against body muscle, b) a spring and slider combination operatively connected with the housing and relatively movable to control spread positioning of said two housing parts, as the slider is displaced lengthwise of said two housing parts, c) and wherein the spring has one end portion thereof attached to said housing, and an opposite free end controllably displaced laterally by the slider, the spring being a flat spring, d) the spring having a deflectable curved portion terminating in an elongated slot defined by an elongated housing part, there being a retainer locally captivating said curved portion, the opposite free end of the spring slidable in said slot relative to housing, the spring confined between said two housing parts to extend in a lengthwise direction defined by said two housing parts.

2. The apparatus of claim 1 wherein the spring is slidably guided on one of said housing parts.

3. The apparatus of claim 1 wherein the slider has sliding engagement with the spring in response to slider displacement lengthwise of the housing, to adjust the housing spread positioning.

4. The apparatus of claim 2 wherein the one end portion of the spring slidably bears laterally against one of said housing parts.

5. The apparatus of claim 1 wherein the slider presses against the spring and is movable in one direction along the spring until the two housing parts are fully opened away from one another, and characterized in that the closer the slider is moved toward the human body, the greater the force required to displace said parts relative to and toward one another.

6. The apparatus of claim 2 wherein the slider engages the spring and is movable in one direction along the spring until the two housing parts are fully opened away from one another, and characterized in that the closer the slider is moved toward the human body, the greater the force required to displace said parts relative to one another.

7. The apparatus of claim 3 wherein the slider presses against the spring and is movable in one direction along the spring until the two housing parts are fully opened away from one another, and characterized in that the closer the slider is moved toward the human body, the greater the force required to displace said parts relative to and toward one another.

* * * * *